US010376061B1

(12) United States Patent
Liu et al.

(10) Patent No.: US 10,376,061 B1
(45) Date of Patent: Aug. 13, 2019

(54) SWIVEL BASE ASSEMBLY FOR USE IN CONJUNCTION WITH AN ELECTRICALLY POWERED CHAIR

(71) Applicants: Chih Hsiung Liu, Benoni (ZA); Mei Jun Xu, Jiujiang (CN); Zhi Liang Gao, Jiangsu (CN); Ya Xin Wu, Changzhou (CN)

(72) Inventors: Chih Hsiung Liu, Benoni (ZA); Mei Jun Xu, Jiujiang (CN); Zhi Liang Gao, Jiangsu (CN); Ya Xin Wu, Changzhou (CN)

(73) Assignee: HHC CHANGZHOU CORPORATION, Changzhou (CN)

( * ) Notice: Subject to any disclaimer, the term of this patent is extended or adjusted under 35 U.S.C. 154(b) by 0 days.

(21) Appl. No.: 15/951,382

(22) Filed: Apr. 12, 2018

(51) Int. Cl.

| | |
|---|---|
| ***A47C 3/18*** | (2006.01) |
| ***A47C 7/00*** | (2006.01) |
| ***A47C 3/025*** | (2006.01) |

(52) U.S. Cl.
CPC ..... *A47C 3/18* (2013.01); *A47C 3/025* (2013.01); *A47C 3/0255* (2013.01); *A47C 7/002* (2013.01); *A47C 7/006* (2013.01)

(58) Field of Classification Search
CPC ..... A47C 7/72; A47C 7/002; A47C 7/006; A47C 3/18; A47C 3/24; A47C 3/025; A47C 3/0255; A47C 1/06; A47C 1/04; A47C 1/02
USPC ..... 297/217.4, 217.3, 344.21, 259.1, 259.3
See application file for complete search history.

(56) References Cited

U.S. PATENT DOCUMENTS

| | | | | |
|---|---|---|---|---|
| 2005/0242635 | A1* | 11/2005 | Cassaday | A47C 1/022 297/217.3 |
| 2007/0035164 | A1* | 2/2007 | North | A47C 1/0242 297/217.1 |
| 2011/0109135 | A1* | 5/2011 | Davis, Jr. | A47C 3/18 297/217.4 |

* cited by examiner

*Primary Examiner* — Milton Nelson, Jr.
(74) *Attorney, Agent, or Firm* — Law Offices of Steven W. Weinrieb

(57) ABSTRACT

A swivel base assembly, for use in conjunction with an electrically powered chair, is disclosed. The swivel base assembly provides the necessary electrical power to the electrically powered chair without the electrical power cord becoming entangled around the upstanding column, or similar support structure, upon which the body portion of the electrically powered chair is mounted upon the swivel base assembly if the electrically powered chair is rotated multiple times through means of an angular displacement or movement of 360° or more, as a result of the disposition of a rotary electrical connected interposed between the swivel base assembly and the electrically powered chair.

6 Claims, 7 Drawing Sheets

SWIVEL BASE ASSEMBLY FOR USE IN CONJUNCTION WITH AN ELECTRICALLY POWERED CHAIR

FIELD OF THE INVENTION

The present invention relates generally to a swivel base assembly for use in conjunction with an electrically powered chair which may comprise, for example, depending upon the particular chair, a powered footrest, a powered headrest, a powered lumbar support, and a powered body portion which is capable of being moved to one or more electrically powered reclined positions, and more particularly to a swivel base assembly which can provide the necessary electrical power to the electrically powered chair without the electrical power cord becoming entangled around the upstanding column, or similar support structure, upon which the body portion of the electrically powered chair is mounted upon the swivel base assembly if the electrically powered chair is rotated multiple times through means of an angular displacement or movement of 360° or more. The swivel base assembly can have various different configurations and can be utilized in conjunction with various different types of chairs such as, for example, an electrically powered recliner chair, an electrically powered recliner/rocker chair, an electrically powered recliner/glider chair, or an electrically powered office chair.

BACKGROUND OF THE INVENTION

Electrically powered chairs, which, depending upon the particular chair, may comprise, for example, an electrically powered recliner chair which may include an electrically powered footrest, an electrically powered headrest, an electrically powered lumbar support section, and an electrically powered body portion which is capable of being moved to one or more electrically powered reclined positions, are often disposed atop a base assembly which permits the electrically powered chair to be swiveled or rotated through an angular displacement or movement of 360° or more while the person is seated within the chair. As can best be appreciated from FIGS. 1*a* and 1*b*, for example, a conventional electrically powered recliner chair assembly is generally indicated by the reference character 100 wherein the body portion 101 of the electrically powered recliner chair assembly 100 is disposed upon a swivel base assembly 102. Electrical power is provided to the electrically powered recliner chair 101 by means of a power cord 104 which, as is schematically illustrated within FIGS. 1*a* and 1*b*, is conventionally connected, at one end thereof, to the electrically powered recliner chair 101, and to a suitable power source PS at the opposite end thereof. As can therefore be readily appreciated, since the electrical power cord 104 is connected to the body portion 101 of the electrically powered recliner chair assembly 100, as opposed to being connected to the swivel base assembly 102 of the electrically powered recliner chair assembly 100, each time the electrically powered recliner chair 101 is rotated through multiple revolutions of 360° or more around the vertically oriented central axis A of the swivel base assembly 102, as schematically illustrated by means of the circular or circumferential arrow 105 illustrated within FIG. 1*b*, the electrical power cord 104 tends to become wrapped, coiled, or entangled around the upstanding column 106 upon which the body portion 101 of the electrically powered recliner chair assembly 100 is mounted upon the swivel base 102, as is also illustrated at 108 in FIG. 1*b*. Eventually, such winding, coiling, or wrapping of the electrical power cord 104 around the upstanding column 106 becomes so entangled that the body portion 101 of the electrically powered recliner chair assembly 100 will no longer be capable of being rotated relative, to its swivel base assembly 102, or damage to the electrical power cord 104 will result, or both.

A need therefore exists in the art for a new and improved swivel base assembly. Another need exists in the art for a new and improved swivel base assembly for use in conjunction with an electrically powered chair. An additional need exists in the art for a new and improved swivel base assembly wherein electrical power can effectively be supplied to the electrically powered chair without the power cord, conducting electrical power to the electrically powered chair, becoming entangled around the upstanding column or similar support structure of the electrically powered chair assembly which supports the electrically powered reclined chair upon the swivel base assembly. A further need exists in the art for a new and improved swivel base assembly wherein electrical power can effectively be supplied to the electrically powered chair without the power cord, conducting electrical power to the electrically powered recliner chair, becoming entangled around the upstanding column or other support structure of the electrically powered chair assembly, which supports the electrically powered chair upon the swivel base assembly, which would otherwise eventually prevent the electrically powered chair from rotating upon its upstanding column or other support structure and relative to its swivel base assembly. A yet further need exists in the art for a new and improved swivel base assembly wherein electrical power can effectively be supplied to the electrically powered chair without the power cord, conducting electrical power to the electrically powered recliner chair, becoming entangled around the upstanding column or similar support structure of the electrically powered chair assembly, which supports the electrically powered chair upon the swivel base assembly, which would otherwise eventually lead to damage to the power cord. A still further need exists in the art for a new and improved swivel base assembly wherein electrical power can effectively be supplied to the electrically powered chair and wherein the new and improved swivel base assembly comprises a swivel base assembly selected from the group comprising a swivel base assembly comprising an annular circular base assembly, a swivel rocker base assembly, a swivel glider base assembly, a swivel base assembly comprising a substantially flat circular disc or platform, and an upstanding support column.

OVERALL OBJECTIVES OF THE INVENTION

Therefore, an overall objective of the present invention is to provide a new and improved swivel base assembly. Another overall objective of the present invention is to provide a new and improved swivel base assembly for use in conjunction with an electrically powered chair. An additional overall objective of the present invention is to provide a new and improved swivel base assembly wherein electrical power can effectively be supplied to the electrically powered chair without the power cord, conducting electrical power to the electrically powered chair, becoming entangled around the upstanding column or similar support structure of the electrically powered chair assembly which supports the electrically powered reclined chair upon the swivel base assembly. A further overall objective of the present invention is to provide a new and improved swivel base assembly wherein electrical power can effectively be supplied to the electrically powered chair without the power cord, conducting electrical power to the electrically powered recliner chair, becoming entangled around the upstanding column or other support structure of the electrically powered chair assembly, which supports the electrically powered chair upon the swivel base assembly, which would otherwise eventually prevent the electrically powered chair from rotating upon its upstanding column or other support structure and relative to its swivel base assembly. A yet further overall objective of the present invention is to provide a new and improved swivel base assembly wherein electrical power can effectively be supplied to the electrically powered chair without the power cord, conducting electrical power to the electrically powered recliner chair, becoming entangled around the upstanding column or similar support structure of the electrically powered chair assembly, which supports the electrically powered chair upon the swivel base assembly, which would otherwise eventually lead to damage to the power cord. A still further overall objective of the present invention is to provide a new and improved swivel base assembly wherein electrical power can effectively be supplied to the electrically powered chair and wherein the new and improved swivel base assembly comprises a swivel base assembly that is selected from the group comprising a swivel base assembly comprising an annular circular base assembly, a swivel rocker base assembly, a swivel glider base assembly, a swivel base assembly comprising a substantially flat circular disc or platform, and an upstanding support column.

SUMMARY OF THE INVENTION

The present invention comprises a new and improved swivel base assembly for use in conjunction with an electrically powered chair, which, depending upon the particular chair, may comprise, for example, an electrically powered recliner chair comprising an electrically powered footrest portion, an electrically powered headrest portion, an electrically powered lumbar support portion, and an electrically powered body portion that can be moved to one or more electrically powered reclined positions. More particularly, the swivel base assembly can provide the necessary electrical power to the electrically powered recliner chair without the use of a power cord being conventionally connected to the electrically powered recliner chair. In accordance with the present invention, the power cord is connected to the swivel base assembly of the electrically powered incliner chair, as opposed to the body portion of the electrically powered recliner chair, and a rotary electrical connector is effectively interposed between the body portion of the electrically powered recliner chair and the swivel base assembly. In this manner, electrical power, derived from a suitable electrical power source, is provided to the swivel base assembly and is conducted through, or transmitted by, the rotary electrical connector to the body portion of the electrically powered recliner chair such that electrically powered recliner chair can then utilize such electrical power to operate the various movable components or portions of the electrically powered recliner chair as noted hereinbefore. As a result of this overall assembly structure, the electrical power cord, which can often conventionally become entangled around the swivel base assembly if the electrical power cord is connected to the body portion of the electrically powered recliner chair, and if the electrically powered recliner chair is rotated multiple times through means of an angular displacement or movement of 360° or more, is effectively prevented from becoming entangled around the swivel base assembly. The swivel base assembly can comprise a swivel base assembly having an annular circular structure, a swivel rocker base assembly, a swivel glider base assembly, a swivel base assembly which comprises a flat circular bas or platform, or an upstanding support column such as those used upon office chairs. In addition, the rotary electrical connector can comprise a rotary interface connector, a rotary electrical interface, a rotary electrical connector, an electrical collector, an electrical swivel, a rotating electrical assembly, a slip ring, or an electrical rotary joint.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE ILLUSTRATED EMBODIMENTS

Figure 1A:
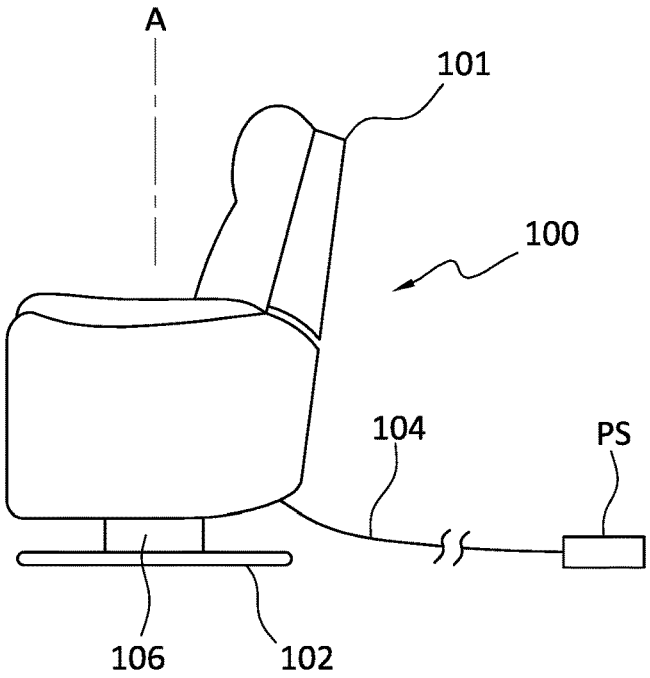
FIG. 1a PRIOR ART
FIG. 1*a* is a schematic side elevational view of a conventional, PRIOR ART electrically powered recliner chair wherein the electrical power cord is illustrated as being electrically connected to the body portion of the electrically powered reclined chair.
Figure 1B:
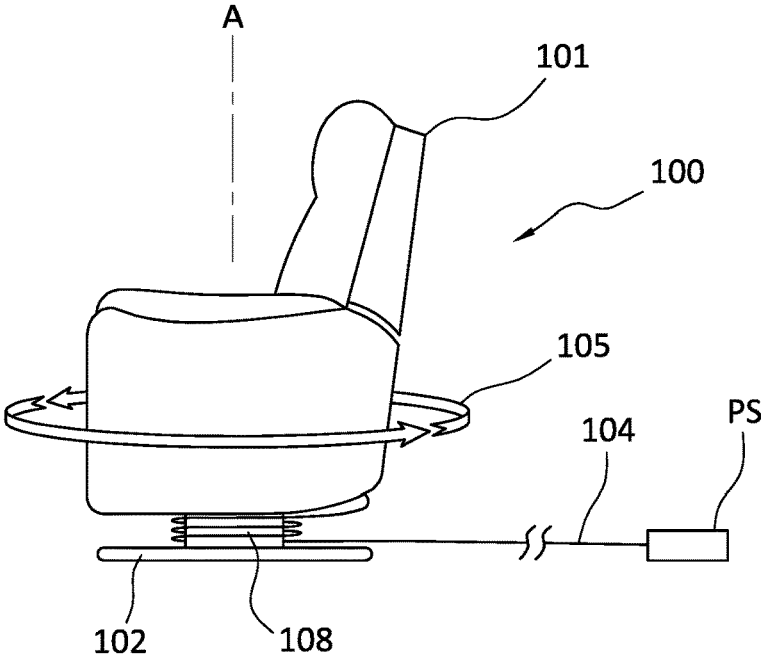
FIG. 1b PRIOR ART
FIG. 1*b* is a schematic side elevational view of the conventional, PRIOR ART electrically powered recliner chair, as illustrated within FIG. 1*a*, wherein after the electrically powered recliner chair has undergone multiple revolutions of 360° or more, the electrical power cord becomes entangled around the upstanding column of the electrically powered recliner chair assembly upon which the body portion of the electrically powered recliner chair is mounted so as to be mounted upon and supported by the swivel base.
Figure 2A:
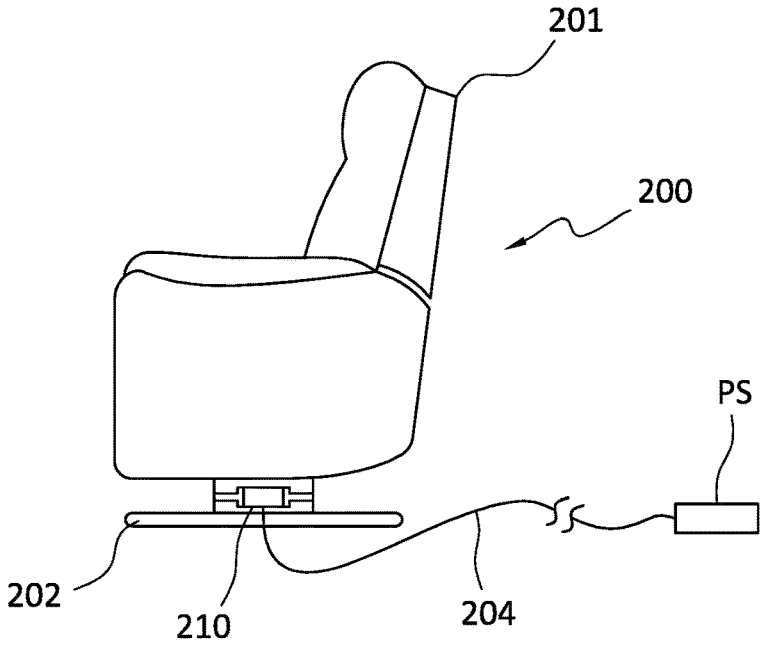
FIG. 2*a* is a schematic side elevational view similar to that of FIG. 1*a* showing, however, a new and improved swivel base assembly as constructed in accordance with the principles and teachings of the present invention wherein the electrical power cord is connected to the swivel base assembly which is seen to comprise upper and lower support plates, and wherein a rotary electrical connector is integrally incorporated within the upper and lower support plates of the swivel base assembly such that electrical power can then be transmitted to the body portion of the electrically powered recliner chair while permitting the body portion of the electrically powered recliner chair assembly to be rotated upon and around the swivel base assembly without causing any entanglement of the electrical power cord around the upper and lower support plates of the electrically powered recliner chair assembly upon which the body portion of the electrically powered recliner chair is mounted and supported.
Figure 2B:
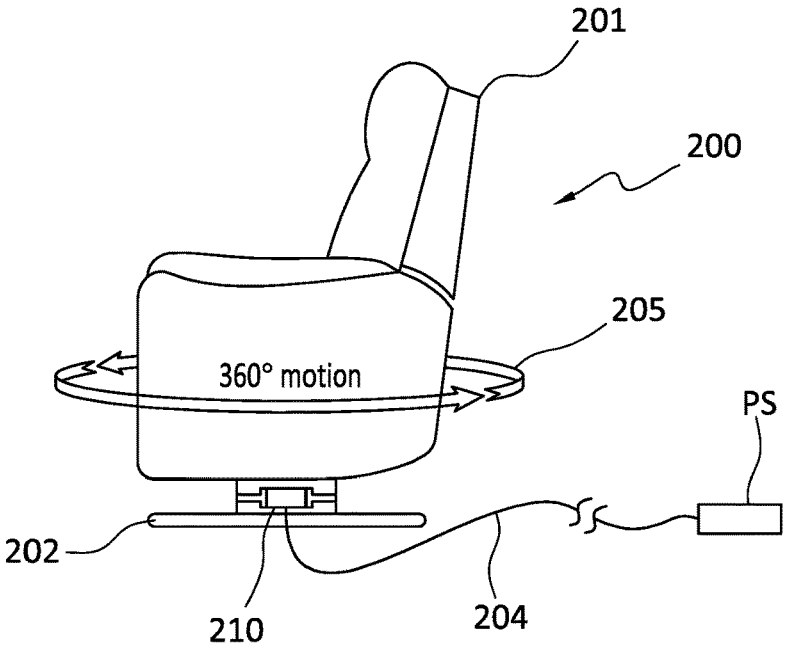
FIG. 2*b* is a schematic side elevational view similar to that of FIG. 1*b* illustrating the fact that despite the electrically powered recliner chair having undergone multiple revolutions of 360° or more, the electrical power cord does not become entangled around the upper and lower support plates of the electrically powered recliner chair assembly upon which the body portion of the electrically powered recliner chair is mounted so as to, in turn, be mounted or supported upon the swivel base assembly.

Referring now to the drawings, and more particularly to FIGS. 2*a* and 2*b*, a conventional electrically powered recliner chair assembly is generally indicated by the reference character 200 wherein the body portion or electrically powered reclined chair 201 of the electrically powered recliner chair assembly 200 is disposed upon a swivel base assembly 202. It is to be noted that components parts of the electrically powered chair assembly 200, which correspond to component parts of the conventional PRIOR ART electrically powered chair assembly 100 will be designated by corresponding reference numbers except that the reference numbers will be within the 200 series. Accordingly, it can be seen that electrical power is provided to the electrically powered recliner chair 201 by means of a power cord 204 which, as can be seen from FIGS. 2*a* and 2*b*, is connected, at one end thereof, to a suitable power source PS, while, unlike the electrical connections operatively associated with the electrically powered recliner chair 101 as illustrated within FIGS. 1*a* and 1*b*, in accordance with the principles and teachings of the present invention, the opposite end of the power cord 204 is electrically connected to a rotary electrical connector 210. It is to be noted that the rotary electrical connector 210 is known by various names in the industry, such as, for example, a rotary interface connector, a rotary electrical interface, a rotary electrical connector, an electrical collector, an electrical swivel, a rotating electrical assembly, a slip ring, or an electrical rotary joint. Therefore, any one of these types of rotary electrical connectors can serve as the rotary electrical connector 210.

In particular, the rotary electrical connector 210 comprises two rotary electrical components which are disposed in engagement with each other and which can also rotate with respect to each other. Each one of the two rotary electrical components is mounted upon a structural component wherein one structural component is adapted to be rotated with respect to the other structural component.

Therefore, as can be appreciated from FIGS. 2*a* and 2*b*, a first lower one of the two rotary electrical components comprising the rotary electrical connector 210 is fixedly mounted upon the swivel base assembly 202, while the second upper one of the two rotary electrical components comprising the rotary electrical connector 210 is fixedly mounted upon the bottom portion of the electrically powered recliner chair 201. In this manner, electrical power is transmitted from the power source PS, through the power cord 204, and to the first lower one of the two rotary electrical components comprising the rotary electrical connector 210 which is fixedly mounted upon the swivel base assembly 202. The electrical power is then, in turn, transmitted from the first lower one of the two rotary electrical components comprising the rotary electrical connector 210 to the second upper one of the two rotary electrical components comprising the rotary electrical connector 210 which is mounted upon the bottom portion of the electrically powered recliner chair 201. Electrical connections, not shown, disposed internally within the electrically powered recliner chair 201, then supply electrical power to at least one electrical actuator, also not shown, which is incorporated within the internal actuating structural system of the electrically powered recliner chair such that at least one portion of the electrically powered recliner chair can be actuated or moved as desired. Such movements can comprise, for example, the movement of an adjustable footrest, an adjustable headrest, an adjustable lumbar support mechanism, or the movement of the body portion of the electrically powered recliner chair 201 such that the electrically powered recliner chair 101 can attain any one of several different inclination positions.

As can therefore be readily appreciated from FIGS. 2*a* and 2*b*, since the electrical power cord 204 is not connected to the body portion or electrically powered recliner chair 201 of the electrically powered recliner chair assembly 200, as was the case with the connection of the electrical power cord 104 to the body portion 101 of the electrically powered recliner chair assembly 100 as illustrated within FIGS. 1*a* and 1*b*, the electrically powered recliner chair 201 is capable of being rotated through multiple revolutions of 360° or more, as schematically illustrated by means of the circular or circumferential arrow 205 illustrated within FIG. 2*b* without causing any coiling, wrapping, or entanglement of the electrical power cord 204 because the electrical power cord 204 never undergoes any movement. All rotary movement of the electrically powered recliner chair 201, relative to the swivel base assembly 202, is effectively compensated for, dissipated, or eliminated by means of the disposition of the rotary electrical connector 210 between the swivel base assembly 202 and the electrically powered recliner chair 201. Therefore, the body portion 201 of the electrically powered recliner chair assembly 200 is not prevented from rotating relative to the swivel base assembly 202, and the electrical power cord 204 does not experience any wear or damage.

Figure 3:
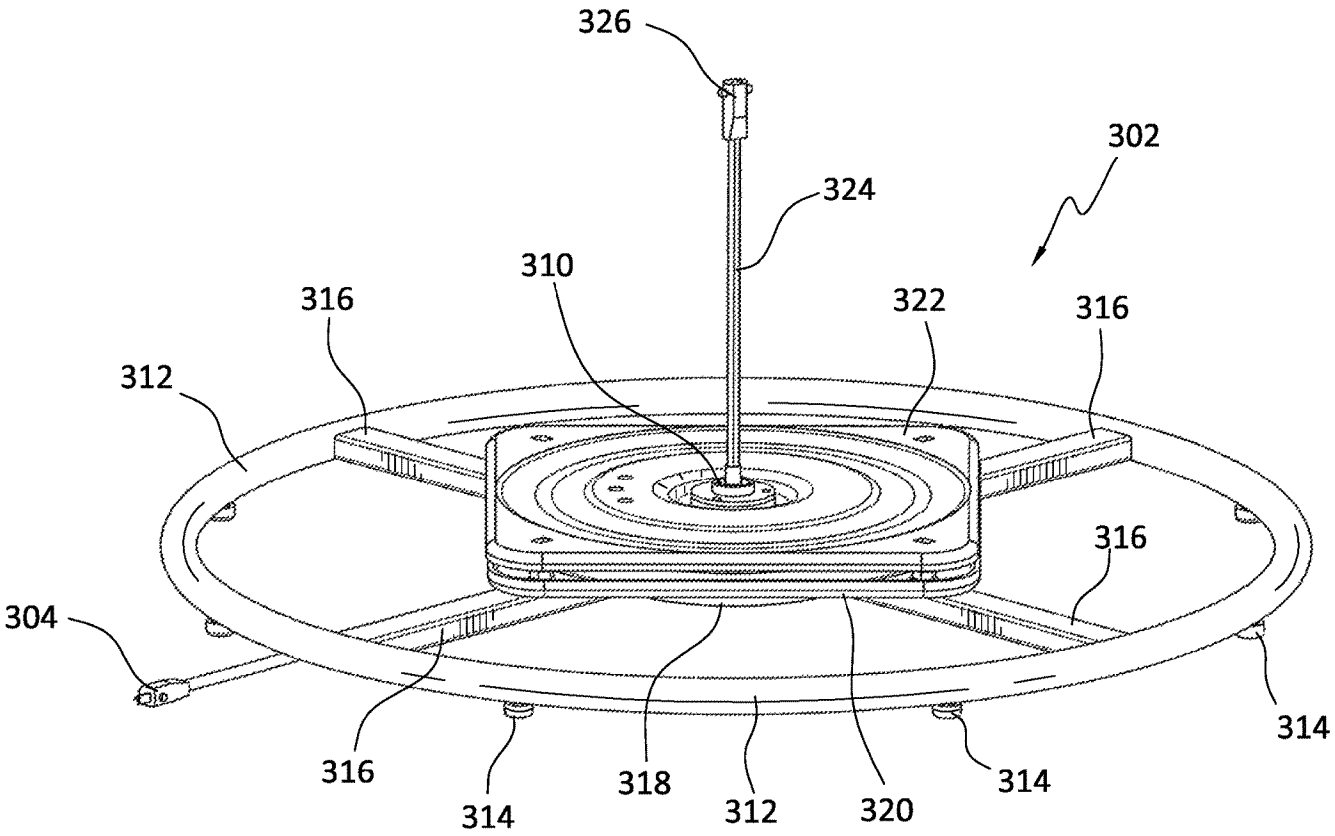
FIG. 3 is a schematic perspective view of a first embodiment of a new and improved swivel base assembly as constructed in accordance with the principles and teachings of the present invention wherein the swivel base assembly is seen to comprise an annular circular structure comprising a plurality of radially extending spokes, and wherein an incoming electrical power cord is routed within or through one of the plurality of radially extending spokes of the swivel base assembly so as to be electrically connected to a lower part of a rotary electrical connector that is mounted at an axially central portion of a lower support plate, while an outgoing electrical power cord is electrically connected to an upper part of the rotary electrical connector which is mounted within an upper support plate so as to transmit electrical power to the body portion of the electrically powered chair.

With reference now being made to FIG. 3, a first embodiment of a swivel base assembly, to be used in conjunction with an electrically powered chair which is to be mounted upon the swivel base assembly, is disclosed and is generally indicated by the reference character 302. It is to be noted that component parts of the swivel base assembly 302, which correspond to component parts of the swivel base assemblies 102,202 disclosed within FIGS. 1*a*-2*b* will be designated by corresponding reference numbers except that the reference numbers will be within the 300 series. More particularly, it is seen that the first embodiment of the new and improved swivel base assembly 302 as constructed in accordance with the principles and teachings of the present invention comprises an annular circular structure 312 which may have a plurality of feet or support structures 314 fixedly mounted upon undersurface portions thereof so as to permit the swivel base assembly 302 to stably mounted upon a floor surface. The annular circular structure 312 further comprises a plurality of radially extending spokes 316 which structurally interconnect the annular circular structure 312 to a central base or platform 318.

Fixedly mounted upon the central base or platform 318 is a first lower mounting plate 320 within or upon which is mounted a first lower component of the rotary electrical connector 310, while a second upper mounting plate 322 is adapted to be fixedly mounted upon the bottom or underside portion of an electrically powered recliner chair, which may be similar to the electrically powered recliner chairs 101,201 disclosed within FIGS. 1*a*-2*b*, or alternatively, the electrically powered chair may be a different type of electrically powered chair. In any case, a second upper component of the rotary electrical connector 310 is adapted to be mounted upon or within the second upper mounting plate 322, and an incoming electrical power cord 304 is adapted to be routed within or through one of the plurality of radially extending spokes 316 of the swivel base assembly 302 so as to be electrically connected to the lower component part of the rotary electrical connector 310. Still further, an outgoing electrical power cord 324 is electrically connected to the upper component part of the rotary electrical connector 310, and the free end portion of the outgoing electrical power cord 324 is provided with an electrical connector 326 which is adapted to be electrically connected to, for example, a suitable actuator for actuating movement of the electrically powered chair or a movable component thereof. As can therefore be appreciated, electrical power is conducted from a suitable power source, such as that disclosed at PS within FIGS. 1*a*-2*b*, conducted through incoming electrical power cord 304, through the rotary electrical connector 310, and through the outgoing electrical power cord 324 and the electrical connector 326. Electrical power is therefore able to be continuously supplied to the electrically powered chair, by means of the rotary electrical connector 310, regardless of how many revolutions the electrically powered chair undergoes with respect to the swivel base assembly 302, without any coiling, wrapping, or entangling of electrical power cords because the electrical power is transmitted through means of the rotary electrical connector 310.

Figure 4:
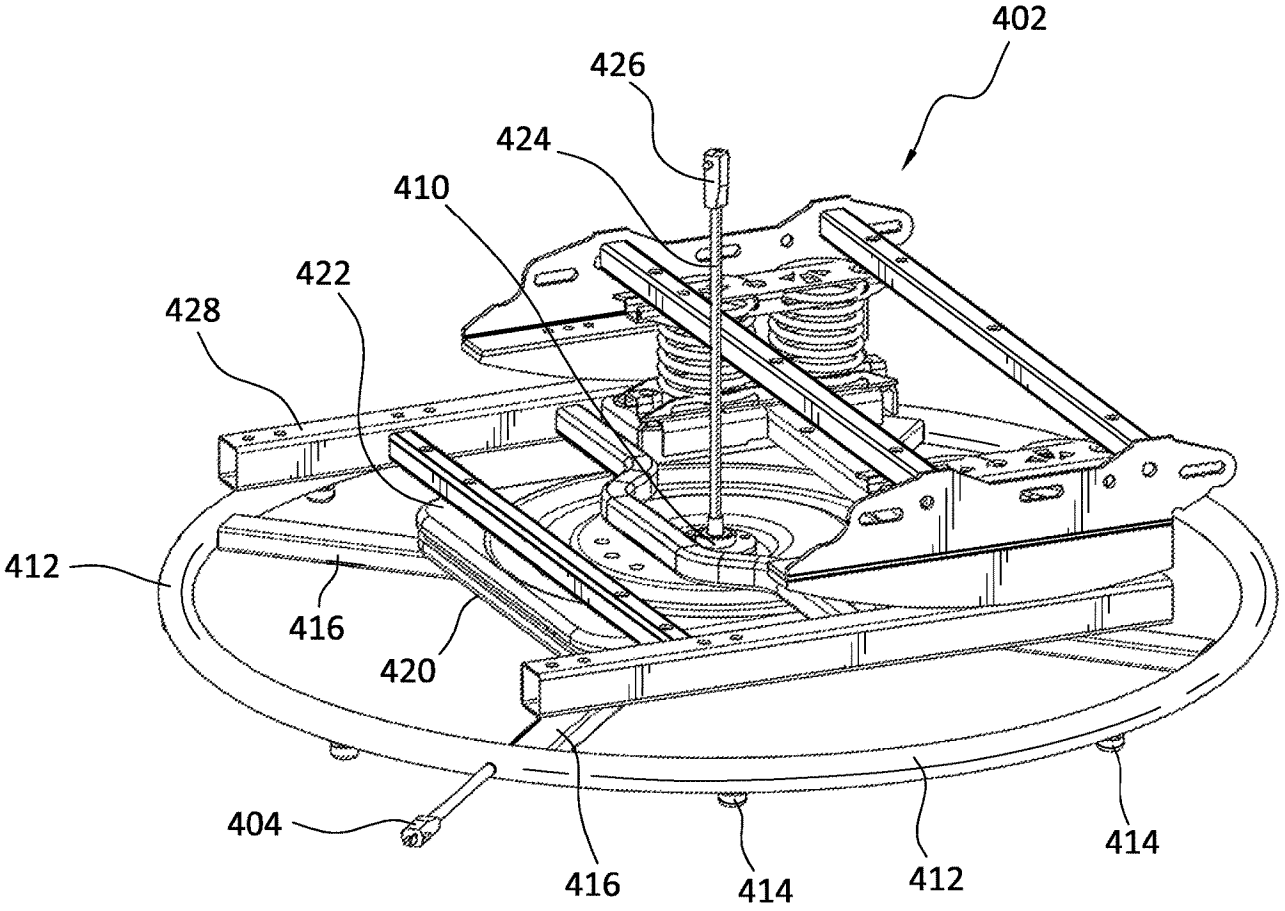
FIG. 4 is a schematic perspective view of a second embodiment of a new and improved swivel base assembly as constructed in accordance with the principles and teachings of the present invention wherein the swivel base assembly is seen to comprise an annular circular structure comprising a plurality of radially extending spokes, wherein a rocker structure has been mounted upon the swivel base assembly so to permit the electrically powered chair, to be mounted upon and connected to the rocker structure, to undergo rocking movement as desired, and wherein an incoming electrical power cord is routed within or through one of the plurality of radially extending spokes of the swivel base assembly so as to be electrically connected to a lower part of a rotary electrical connector that is mounted at an axially central portion of a lower support plate, while an outgoing electrical power cord is electrically connected to an upper part of the rotary electrical connector which is mounted within an upper support plate so as to transmit electrical power to the body portion of the electrically powered chair.

With reference now being made to FIG. 4, a second embodiment of a new and improved swivel base assembly as constructed in accordance with the principles and teachings of the present invention is disclosed and is generally indicated by means of the reference number 402. It is to be noted that component parts of the swivel base assembly 402, which correspond to component parts of the swivel base assemblies 102,202,302 disclosed within FIGS. 1*a*-3 will be designated by corresponding reference numbers except that the reference numbers will be within the 400 series. More particularly, it is seen that the second embodiment of the new and improved swivel base assembly 402, as constructed in accordance with the principles and teachings of the present invention, comprises an annular circular structure 412, a plurality of radially extending spokes 416 interconnecting the annular circular structure 412 to a central platform, not shown, upon which the lower and upper mounting plates 420,422 are disposed, however, in addition to such structural components, a rocker structural assembly 428 is mounted atop the upper mounting plate 422 so to permit the electrically powered chair, which is mounted upon and connected to the rocker structure, to undergo rocking movement as desired.

Figure 5:
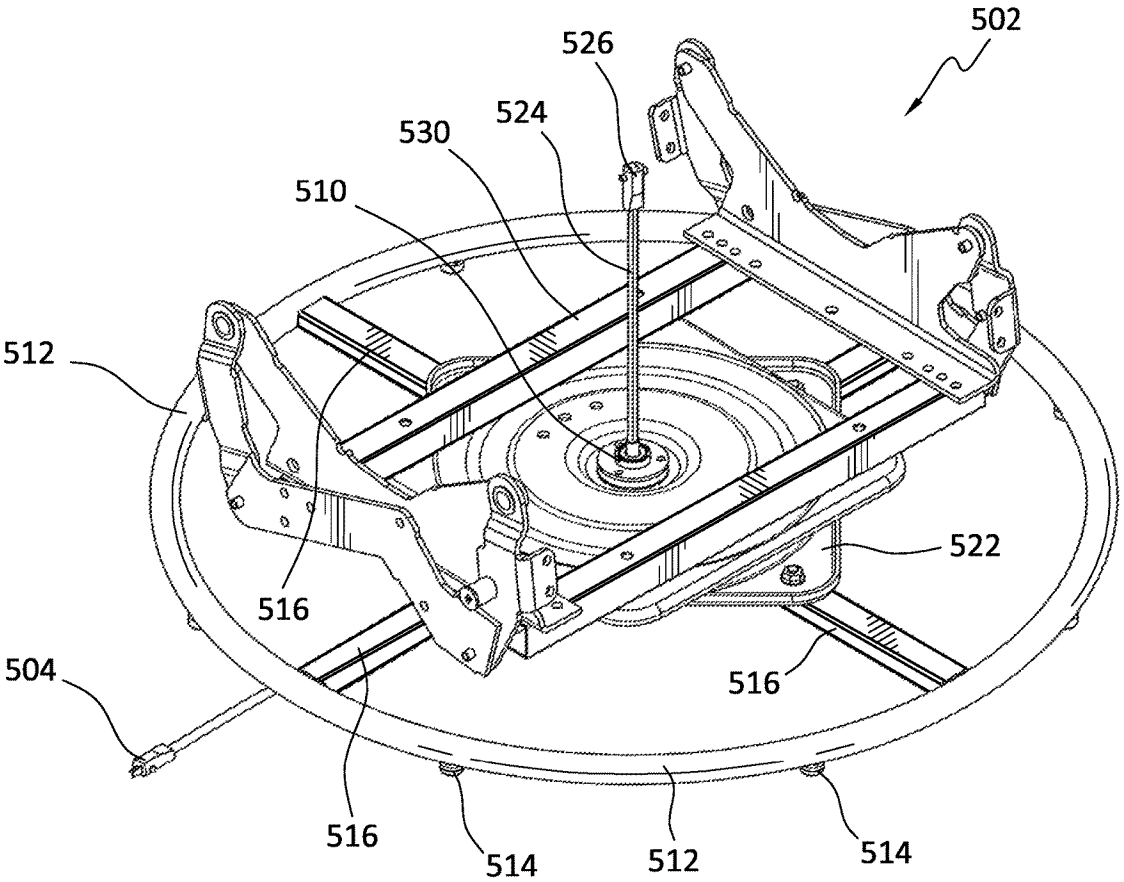
FIG. 5 is a schematic perspective view of a third embodiment of a new and improved swivel base assembly as constructed in accordance with the principles and teachings of the present invention wherein the swivel base assembly is seen to comprise an annular circular structure comprising a plurality of radially extending spokes, wherein a glider structure has been mounted upon the swivel base assembly so to permit the electrically powered chair, to be mounted upon and connected to the glider structure, to undergo gliding movement as desired, and wherein an incoming electrical power cord is routed within or through one of the plurality of radially extending spokes of the swivel base assembly so as to be electrically connected to a lower part of a rotary electrical connector that is mounted at an axially central portion of a lower support plate, while an outgoing electrical power cord is electrically connected to an upper part of the rotary electrical connector which is mounted within an upper support plate so as to transmit electrical power to the body portion of the electrically powered chair.

With reference now being made to FIG. 5, a third embodiment of a new and improved swivel base assembly as constructed in accordance with the principles and teachings of the present invention is disclosed and is generally indicated by means of the reference number 502. It is to be noted that component parts of the swivel base assembly 502, which correspond to component parts of the swivel base assemblies 102-402 disclosed within FIGS. 1*a*-4 will be designated by corresponding reference numbers except that the reference numbers will be within the 500 series. More particularly, it is seen that the third embodiment of the new and improved swivel base assembly 502, as constructed in accordance with the principles and teachings of the present invention, comprises an annular circular structure 512, a plurality of radially extending spokes 516 interconnecting the annular circular structure 512 to a central platform, not shown, upon which the lower and upper mounting plates, only upper mounting plate 422 being visible, are disposed, however, in addition to such structural components, a glider structural assembly 530 is mounted atop the upper mounting plate 422 so to permit the electrically powered chair, which is mounted upon and connected to the glider structure, to effectively undergo linear back and forth gliding movement as desired. Any suitable gliding structure may be employed as the gliding structure, mechanism, or assembly 530, such as, for example, the gliding structure or mechanism as disclosed within U.S. Pat. No. 7,997,644 which issued to Hoffman et al. on Aug. 16, 2011.

Figure 6:
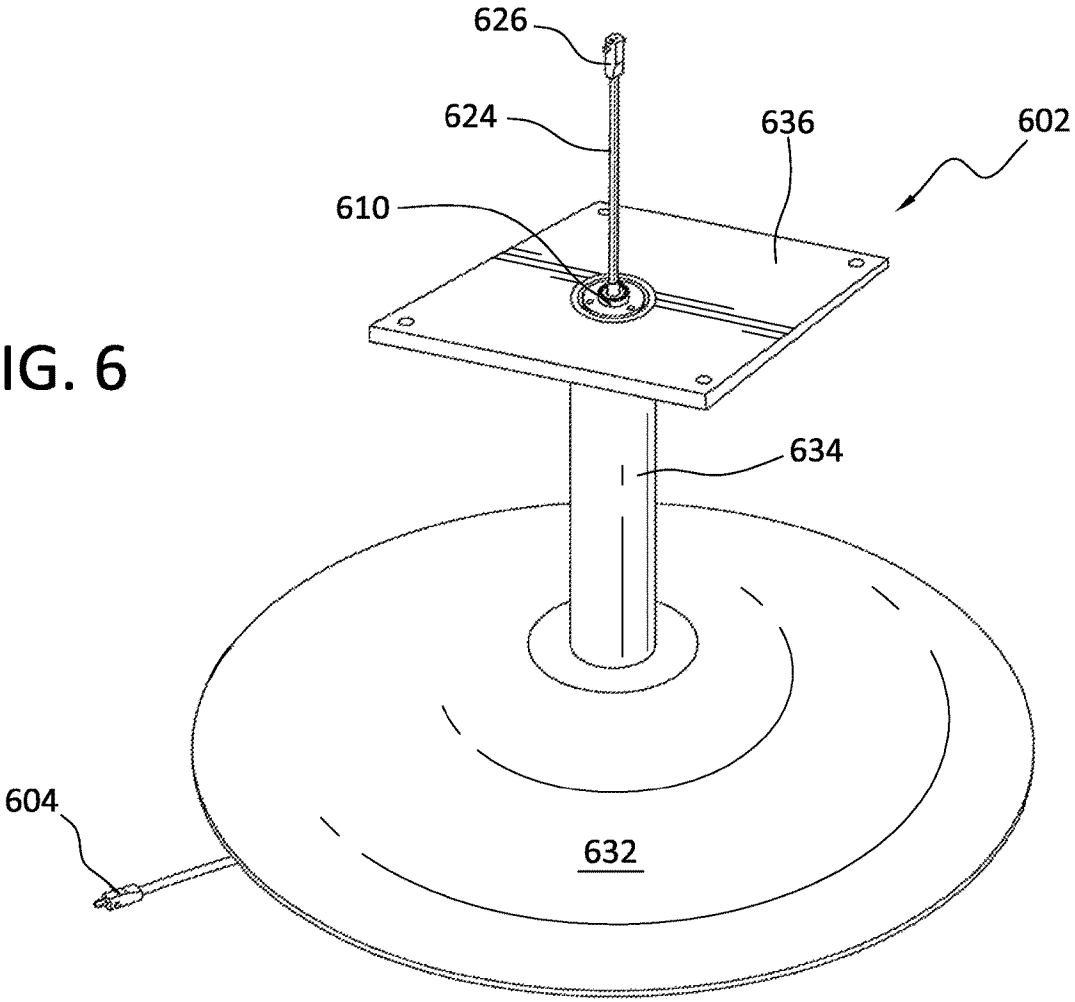
FIG. 6 is a schematic perspective view of a fourth embodiment of a new and improved swivel base assembly as constructed in accordance with the principles and teachings of the present invention wherein the swivel base assembly is seen to comprise a circular structure comprising a substantially flat or slightly spherical, circular plate or platform, wherein an upstanding support column extends vertically upwardly from an axially central portion of the swivel base assembly for mounting an electrically powered chair thereon, and wherein an incoming electrical power cord is routed underneath the swivel base assembly platform and upwardly through the upstanding support column so as to be electrically connected to a lower part of a rotary electrical connector that is mounted upon the upper end of the upstanding support column, while an outgoing electrical power cord is electrically connected at a lower end portion thereof to an upper part of the rotary electrical connector while an opposite end of the outgoing electrical power cord is provided with a suitable electrical connector for electrical connection to a suitable electrical input located upon the electrically powered chair so as to transmit electrical power to the body portion of the electrically powered chair.

Turning now to FIG. 6, there illustrated a fourth embodiment of a new and improved swivel base assembly which has been constructed in accordance with the principles and teachings of the present invention and which is designated by the reference number 602. It is to be noted that component parts of the swivel base assembly 602, which correspond to component parts of the swivel base assemblies 102-502 disclosed within FIGS. 1*a*-5 will be designated by corresponding reference numbers except that the reference numbers will be within the 600 series. More particularly, it is seen that the fourth embodiment of the new and improved swivel base assembly 602, as constructed in accordance with the principles and teachings of the present invention, comprises a circular structure comprising a substantially flat or slightly spherical, circular plate or platform 632, and an upstanding support column 634 that extends vertically upwardly from an axially central portion of the swivel base assembly 602 for mounting an electrically powered chair thereon. More particularly, a chair mounting plate 636 is rotatably mounted upon the upper free end portion of the vertically upstanding support column 634, and the chair mounting plate 636 is adapted to be secured to the bottom or underside portion of the electrically powered chair such that the electrically powered chair is fixedly mounted upon the chair mounting plate 636 and is able to rotate relative to the vertically upstanding support column. Accordingly, an upper component of a rotary electrical connector 610 is mounted within the chair mounting plate 636, while a lower component of the rotary electrical connector 610 is mounted within the upper end of the vertically upstanding support column 634. It is also noted that the first incoming electrical power cord or cable 604 is routed beneath or under the circular plate or platform 632 and vertically upwardly within the vertically upstanding support column 634 so as to be electrically connected to the lower component, not shown, of the rotary electrical connector 610. Therefore, when the electrically powered chair rotates or revolves around the vertically upstanding support column 634, electrical power can nevertheless be transmitted from the first incoming electrical power cable or cord 604, to the rotary electrical connector 610, through the second outgoing electrical power cord or cable 624, and to the electrical connector 626 such that electrical power can in fact be provided to the electrically powered chair as needed.

Figure 7:
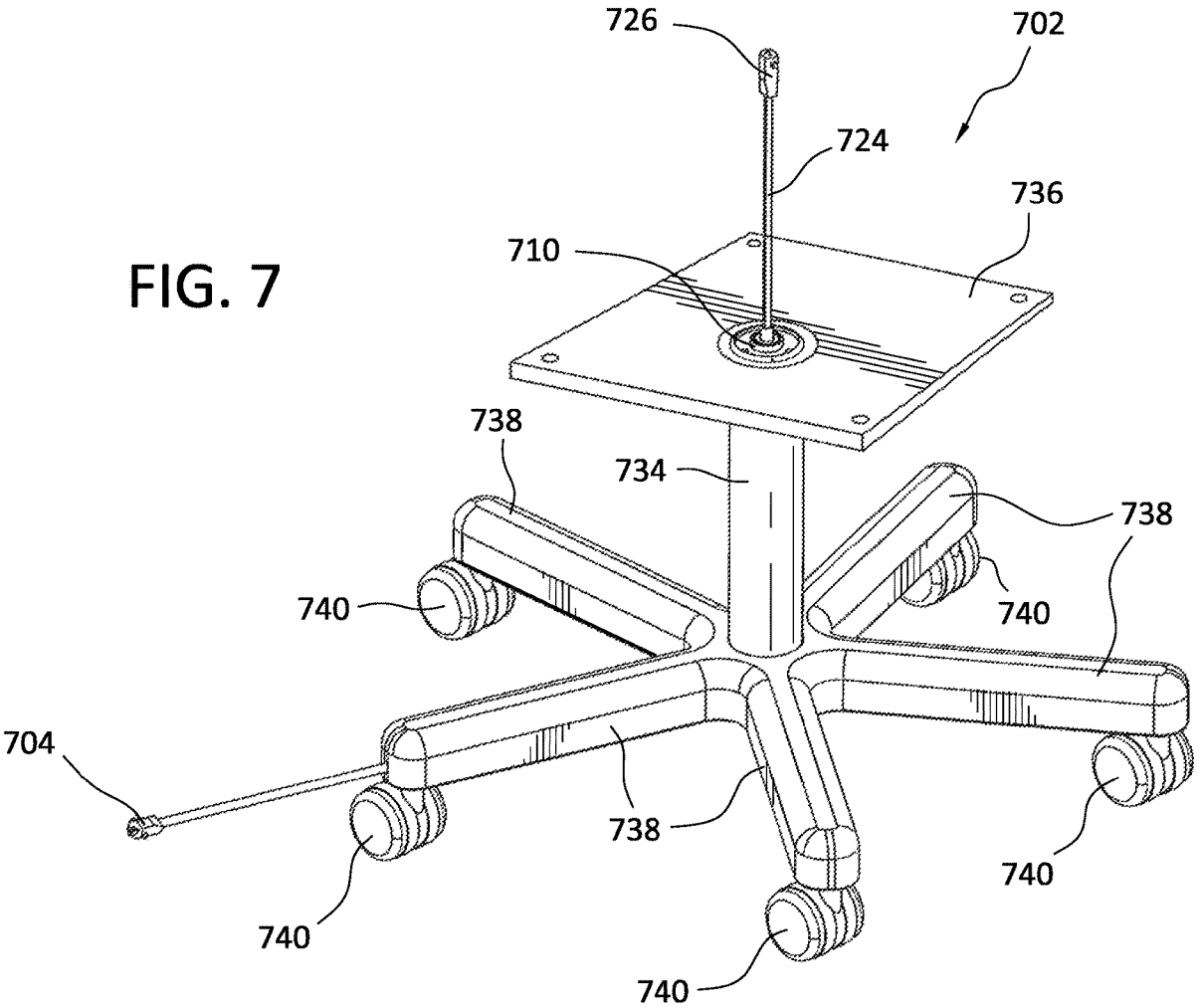
FIG. 7 is a schematic perspective view of a fifth embodiment of a new and improved swivel base assembly as constructed in accordance with the principles and teachings of the present invention wherein the swivel base assembly is seen to comprise a five-legged base assembly, conventionally seen upon office chairs, wherein the five-legged base assembly comprises five equiangularly spaced, radially outwardly oriented leg members, and an upstanding support column which extends vertically upwardly from an axially central connection portion of the five legs comprising the base assembly for mounting an electrically powered chair thereon, and wherein an incoming electrical power cord is routed through one of the radially extending legs of the base assembly and upwardly through the upstanding support column so as to be electrically connected to a lower part of a rotary electrical connector that is mounted upon the upper end of the upstanding support column, while an outgoing electrical power cord is electrically connected at a lower end portion thereof to an upper part of the rotary electrical connector while an opposite end of the outgoing electrical power cord is provided with a suitable electrical connector for electrical connection to a suitable electrical input located upon the electrically powered chair so as to transmit electrical power to the body portion of the electrically powered chair.

With reference lastly being made to FIG. 7, there is disclosed a fifth embodiment of a new and improved swivel base assembly as constructed in accordance with the principles and teachings of the present invention and which is designated by the reference number 702. It is to be noted that component parts of the swivel base assembly 702, which correspond to component parts of the swivel base assemblies 102-602 disclosed within FIGS. 1*a*-6 will be designated by corresponding reference numbers except that the reference numbers will be within the 700 series. More particularly, it is seen that the fourth embodiment of the new and improved swivel base assembly 702, as constructed in accordance with the principles and teachings of the present invention, comprises a five-legged base assembly, conventionally seen upon office chairs, wherein the five-legged base assembly comprises five equiangularly spaced, radially outwardly oriented leg members 738, and an upstanding support column 734, which extends vertically upwardly from an axially central junction portion of the five legs 738 comprising the swivel base assembly 702, for mounting an electrically powered chair thereon through means of a chair mounting plate 736, all of such structure being similar to the structure previously discussed in connection with the swivel base assembly 602.

Caster wheels 740 are mounted beneath the distal end portions of the five legs 738 so as to permit the electrically powered chair to be easily moved upon a floor surface, and it is seen that the first incoming electrical power cord or cable 704 is routed through one of the radially extending legs 738 of the swivel base 702 assembly and upwardly through the vertically upstanding support column 734 so as to be electrically connected to a lower component part of the rotary electrical connector 710 that is mounted upon the upper end of the vertically upstanding support column 734. An upper component part of the rotary electrical connector 710 is mounted within the chair mounting plate 736 while a second outgoing electrical power cord or cable 724 is electrically connected at its lower end portion to the upper component part of the rotary electrical connector 710. The opposite end of the outgoing electrical power cord 724 is provided with a suitable electrical connector 726 for electrical connection to a suitable electrical input located upon the electrically powered chair so as to transmit electrical power to the electrically powered chair in order to enable the electrically powered chair to achieve electrically powered functions as desired.

Obviously, many variations and modifications of the present invention are possible in light of the above teachings. For example, while the foregoing disclosure has discussed the transmission of electrical power from an external power source, through the electrical rotary connector, and to the electrically powered chair, a somewhat similar system can be employed for transmitting communication signals. For example, the electrically powered chair can be situated within a particular room of a residence or other establishment, and a person, user, or consumer can be seated in the chair. The person, user, or consumer can have an electrical device, such as, for example, a smart phone, a tablet, or other electrical device from which he wants to control the playing of music through speakers optimally situated within the room. The electrical device can be plugged into, for example, a USB port or other electrical connection built into an arm structure of the chair so as to send suitable signal commands to, for example, play particular music selections stored within the electrical device. The room speakers would be electrically connected to the rotary electrical connector whereby the command signals transmitted from the electrical device of the user would be transmitted through the rotary electrical connector whereby the speakers would be enabled so as to result in the music being played as desired by the user. It is therefore to be understood that within the scope of the appended claims, the present invention may be practiced otherwise than as specifically described herein.

What is claimed is:

1. An electrically powered chair assembly, comprising:

an electrically powered chair;

a mounting plate upon which said electrically powered chair is to be fixedly mounted;

a swivel base engaged with a floor region for supporting said electrically powered chair such that said electrically powered chair can rotate or revolve around a vertically oriented central axis of said swivel base;

an electrical power source;

an electrical power cord electrically connected at a first end portion thereof to said electrical power source; and a rotary electrical connector interposed between said swivel base and said electrically powered chair, and electrically connected to a second opposite end portion of said electrical power cord, so as to provide electrical power to said electrically powered chair in such a manner that said electrically powered chair can rotate or revolve around said vertically oriented central axis of said swivel base without causing said electrical power cord to become coiled, wound, or entangled, regardless of the number of revolutions said electrically powered chair undergoes relative to said swivel base;

wherein said swivel base comprises an annular circular structure, a platform disposed at a central portion of said annular circular structure, and a plurality of radially extending spokes interconnecting said annular circular structure to said platform;

wherein said rotary electrical connector is disposed upon said platform; and wherein said electrical power cord is routed through one of said plurality of radially extending spokes so as to be electrically connected to said rotary electrical connector.

2. The electrically powered chair assembly as set forth in claim 1, wherein:

said rotary electrical connector can be any rotary electrical connector selected from the group consisting of a rotary electrical connector, a rotary interface connector, a rotary electrical interface, an electrical collector, an electrical swivel, a rotating electrical assembly, a slip ring, and an electrical rotary joint.

3. The electrically powered chair assembly as set forth in claim 1, further comprising:

a glider mechanism mounted upon said platform;

whereby said electrically powered chair can undergo gliding movements in addition to rotating or revolving movements around said vertically oriented axis of said swivel base.

4. The electrically powered chair assembly as set forth in claim 1, further comprising:

a rocker mechanism mounted upon said platform;

whereby said electrically powered chair can undergo rocking movements in addition to rotating or revolving movements around said vertically oriented axis of said swivel base.

5. An electrically powered chair assembly, comprising:

an electrically powered chair;

a swivel base engaged with a floor region for supporting said electrically powered chair such that said electrically powered chair can rotate or revolve around a vertically oriented central axis of said swivel base;

an electrical power source;

an electrical power cord electrically connected at a first end portion thereof to said electrical power source; and a rotary electrical connector interposed between said swivel base and said electrically powered chair, and electrically connected to a second opposite end portion of said electrical power cord, so as to provide electrical power to said electrically powered chair in such a manner that said electrically powered chair can rotate or revolve around said vertically oriented central axis of said swivel base without causing said electrical power cord to become coiled, wound, or entangled, regardless of the number of revolutions said electrically powered chair undergoes relative to said swivel base;

wherein said swivel base comprises a multi-legged base structure comprising a plurality of legs extending radially outwardly from a central junction portion;

a vertically upstanding support column is fixedly secured at a lower end portion thereof to said central junction portion of said swivel base; and a mounting plate is rotatably connected to an upper end portion of said vertically upstanding support column and is adapted to be fixedly connected to a bottom portion of said electrically powered chair;

wherein said rotary electrical connector is mounted within said upper end portion of said vertically upstanding support column; and wherein said electrical power cord is routed through one of said plurality of legs of said swivel base and vertically upwardly through said vertically upstanding support column so as to be electrically connected to said rotary electrical connector.

6. An electrically powered chair assembly, comprising:

an electrically powered chair;

a swivel base engaged with a floor region for supporting said electrically powered chair such that said electrically powered chair can rotate or revolve around a vertically oriented central axis of said swivel base;

an electrical power source;

an electrical power cord electrically connected at a first end portion thereof to said electrical power source; and a rotary electrical connector interposed between said swivel base and said electrically powered chair, and electrically connected to a second opposite end portion of said electrical power cord, so as to provide electrical power to said electrically powered chair in such a manner that said electrically powered chair can rotate or revolve around said vertically oriented central axis of said swivel base without causing said electrical power cord to become coiled, wound, or entangled, regardless of the number of revolutions said electrically powered chair undergoes relative to said swivel base;

wherein said swivel base comprises a circular platform; a vertically upstanding support column fixedly secured at a lower end portion thereof to an axially central portion of said circular platform; and a mounting plate rotatably connected to an upper end portion of said vertically upstanding support column and adapted to be fixedly connected to a bottom portion of said electrically powered chair;

wherein said rotary electrical connector is mounted within said upper end portion of said vertically upstanding support column; and wherein said electrical power cord is routed underneath said circular platform and vertically upwardly through said vertically upstanding support column so as to be electrically connected to said rotary electrical connector.

* * * * *